US006866168B2

(12) United States Patent
Petit

(10) Patent No.: US 6,866,168 B2
(45) Date of Patent: Mar. 15, 2005

(54) FLUID DISPENSER PUMP

(75) Inventor: Ludovic Petit, Vitot (FR)

(73) Assignee: Valois SAS, Le Neubourg (FR)

( * ) Notice: Subject to any disclaimer, the term of this patent is extended or adjusted under 35 U.S.C. 154(b) by 0 days.

(21) Appl. No.: 10/417,212

(22) Filed: Apr. 17, 2003

(65) Prior Publication Data

US 2003/0197034 A1 Oct. 23, 2003

Related U.S. Application Data

(60) Provisional application No. 60/387,565, filed on Jun. 12, 2002.

(30) Foreign Application Priority Data

Apr. 17, 2002 (FR) ..... 02 04814

(51) Int. Cl.[7] ..... B65D 88/54

(52) U.S. Cl. ..... 222/321.9; 222/321.2; 222/341

(58) Field of Search ..... 222/321.1, 321.2, 222/321.5–321.9, 341; 239/329, 331, 333, 337

(56) References Cited

U.S. PATENT DOCUMENTS 5,176,296 A 1/1993 Lina et al.
5,303,854 A 4/1994 Cater
5,409,146 A * 4/1995 Hazard et al. ..... 222/321.8
5,664,706 A * 9/1997 Cater ..... 222/321.2

* cited by examiner

*Primary Examiner*—J. Casimer Jacyna
(74) *Attorney, Agent, or Firm*—Sughrue Mion, PLLC

(57) ABSTRACT

A manually-actuated fluid dispenser pump including a pump body (10) containing a pump chamber (20), said pump chamber (20) being defined between an inlet valve (30) and an outlet valve (40), a piston (50) being mounted to slide in said pump body (10) between a rest position and a dispensing position for dispensing the fluid contained in the pump chamber, said piston (50) being connected to, and in particular integral with, an actuating rod (60) provided with an expulsion channel (65), said inlet valve (30) including an inlet valve element (31) mounted to move in the pump body (10) and co-operating with said pump body (10) or with an element secured to or integral with said pump body to define the open and the closed positions for said inlet valve (30), said outlet valve (40) including an outlet valve element (41) mounted to move in the pump body (10) and co-operating with said actuating rod (60) or with an element secured to or integral with said actuating rod to define the open and the closed positions for said outlet valve (40), said fluid dispenser pump being characterized in that, during actuation, said outlet valve (40) is urged into its closed position by the pressure from the fluid contained in the pump body (20), said outlet valve element (41) being moved into the open position of the outlet valve (40) by said inlet valve element (31) when the piston (50) reaches its dispensing position.

7 Claims, 2 Drawing Sheets

FLUID DISPENSER PUMP

CROSS REFERENCE TO RELATED APPLICATION

This application claims the benefit under 35 U.S.C. §119 (e) of pending U.S. provisional patent application Ser. No. 60/387,565, filed Jun. 12, 2002, and priority under 35 U.S.C. §119(a)–(d) of French patent application No. FR-02.04814, filed Apr. 17, 2002.

TECHNICAL FIELD

The present invention relates to a manually-actuated fluid dispenser pump, and to a fluid dispenser device including such a pump.

BACKGROUND OF THE INVENTION

In known manner, a fluid dispenser pump generally includes a pump body in which a piston is mounted to slide between a rest position and a dispensing position. When the pump is a metered dose pump, i.e. a pump that dispenses accurate and identical metered quantities or "doses" each time it is actuated, the pump body can contain a pump chamber that is generally defined between an inlet valve and an outlet valve. In which case, it is essential for the outlet valve to be leaktight during actuation so as to avoid any leakage before the end of actuation, and, similarly, the leaktightness of the inlet valve must also be excellent in order to avoid any of the fluid contained in the pump chamber flowing back into the reservoir during actuation. Another problem that can arise relates to priming, i.e. to removing the air contained in the pump chamber before the pump is actuated for the first time. In certain pumps, the air is removed via the outlet valve towards the dispensing orifice. That solution is not always su-table when the device is provided with closure means for closing off the dispensing orifice, and in particular when such closure means prevent the air from being removed during priming. Another solution consists in providing a hole in the pump body and in removing the air through said hole. Unfortunately, that solution makes it necessary to provide means for closing off the hole after priming, which can make the structure of the pump relatively complex.

BRIEF SUMMARY OF THE INVENTION

An object of the present invention is to provide a fluid dispenser pump that does not suffer from the above-mentioned drawbacks.

An object of the present invention is thus to provide a fluid dispenser pump that guarantees excellent leaktightness at the outlet valve and at the inlet valve while the pump is being actuated, thereby removing any risk of the fluid contained in the pump chamber leaking out or flowing back, and thus guaranteeing that metering is accurate and reproducible.

Another object of the present invention is to provide a fluid dispenser pump that makes it simple and easy for the pump to be primed, even when the device incorporating the pump is provided with closure means.

An object of the present invention is also to provide such a fluid dispenser pump that is simple and inexpensive to manufacture and to assemble.

The present invention thus provides a manually-actuated fluid dispenser pump including a pump body containing a pump chamber, said pump chamber being defined between an inlet valve and an outlet valve, a piston being mounted to slide in said pump body between a rest position and a dispensing position for dispensing the fluid contained in the pump chamber, said piston being connected to, and in particular integral with, an actuating rod provided with an expulsion channel, said inlet valve including an inlet valve element mounted to move in the pump body and co-operating with said pump body or with an element secured to or integral with said pump body to define the open and the closed positions for said inlet valve, said outlet valve including an outlet valve element mounted to move in the pump body and co-operating with said actuating rod or with an element secured to or integral with said actuating rod to define the open and the closed positions for said outlet valve, said fluid dispenser pump being characterized in that, during actuation, said outlet valve is urged into its closed position by the pressure from the fluid contained in the pump body, said outlet valve element being moved into the open position of the outlet valve by said inlet valve element when the piston reaches its dispensing position.

Advantageously, said inlet valve element includes a bottom hollow axial sleeve which, when said inlet valve is in the closed position, slides in leaktight manner around a hollow axial tube secured to or integral with the pump body, the bottom end of said bottom sleeve being spaced apart from the top end of said axial tube when said inlet valve is in the open position to define a passageway through which fluid can flow into the pump chamber.

Advantageously, said axial tube (12) of the pump body is provided with one or more radial projections cooperating with the bottom end of said bottom sleeve of the inlet valve element when the pump is actuated for the first time to open up a passageway for expelling the air contained in the pump chamber so as to prime the pump.

Advantageously, said inlet valve element includes a top hollow axial sleeve whose top edge forms an inwardly-extending radial shoulder and which is mounted to slide around said outlet valve element between bottom and top outwardly-extending radial shoulders on said outlet valve element.

Advantageously, said top edge of the top sleeve cooperates with said bottom shoulder of the outlet valve element to open said outlet valve when the piston reaches its dispensing position.

Advantageously, said top edge of the top sleeve cooperates with said top shoulder on the outlet valve element to close said outlet valve again once the fluid contained in the pump chamber has been expelled.

Advantageously, a spring is disposed between the pump body and the inlet valve element, said spring urging said inlet valve into its open position and urging the piston into its rest position.

The present invention also provides a fluid dispenser device including a pump as defined above.

BRIEF DESCRIPTION OF THE DRAWINGS

Other characteristics and advantages of the present invention will appear more clearly on reading the following detailed description of two embodiments of it, given with reference to the accompanying drawings which are given by way of non-limiting example, and in which.

DETAILED DESCRIPTION

Figure 3:
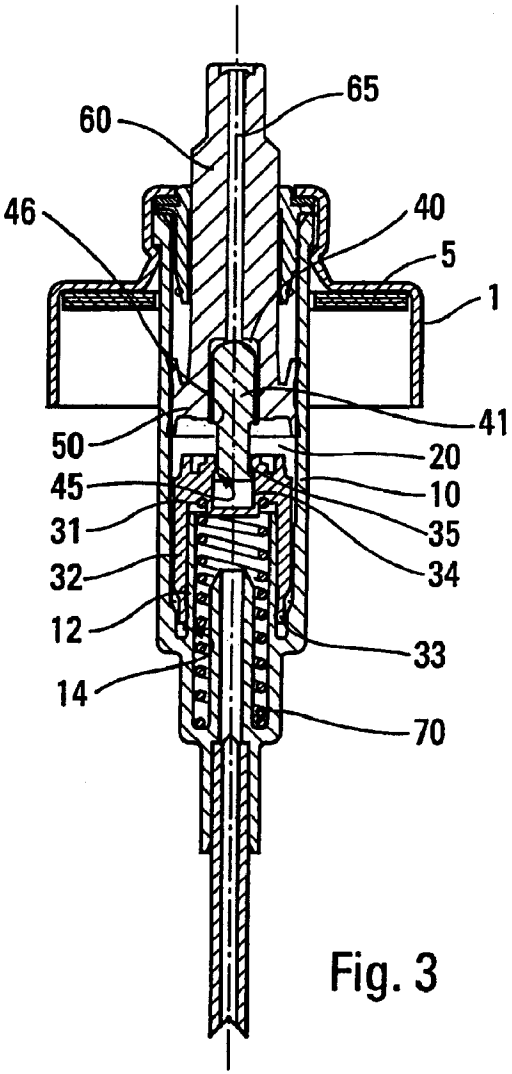
FIG. 3 is a view similar to the views in FIGS. 1 and 2, in the dispensing position.
Figure 6:
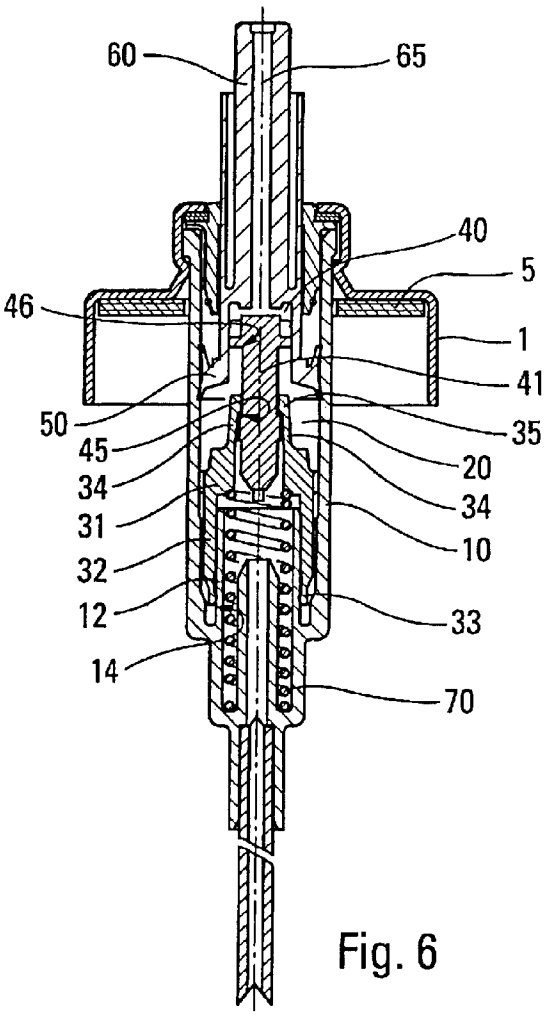
FIG. 6 is a view similar to the views in FIGS. 4 and 5, in the dispensing position.

As shown in the figures, the pump of the present invention includes a pump body 10, in which a piston 50 is mounted to slide between a rest position (shown in FIGS. 1 and 4), and a dispensing position (shown in FIGS. 3 and 6). The piston 50 is connected to and preferably integral with an actuating rod 60 on which the user exerts an axial force, e.g. by means of a pusher (not shown) or of a dispensing head (not shown). The actuating rod 60 may be hollow, and it is generally provided with an expulsion channel 65 making it possible to expel the fluid. The pump body 10 contains a pump chamber 20 defined between an inlet valve 30 and an outlet valve 40. The inlet valve 30 includes an inlet valve element 31 that co-operates with the pump body 10 or with an element secured to or integral therewith to define the open and the closed positions for said inlet valve 30. Similarly, the outlet valve 40 includes an outlet valve element 41 which co-operates with the actuating rod 60 (or with an element secured to or integral therewith) to define the open and the closed positions for said outlet valve 40. The inlet valve element 31 and the outlet valve element 41 are both mounted to move inside the pump body 10. The pump of the invention may be fitted to a reservoir (not shown) by means of a fixing ring 1 which may be of any type, in particular screw-fastenable, crimpable, or snap-fastenable. Generally, a sealing gasket 5 is interposed between the top edge of the reservoir (not shown) and the fixing ring 1. A dispensing head or pusher is then assembled to the pump for the purpose of actuating it, thereby forming a manually-actuated fluid dispenser device.

In the invention, the outlet valve 40 is urged into its closed position by the pressure from the fluid contained in the pump chamber 20. This guarantees that there is no risk of any leakage while the pump is being actuated since, as soon as the user actuates the pump, pressure is generated inside the pump chamber 20, and this pressure urges the outlet valve 40 into its closed position, thereby enhancing leaktightness at said outlet valve. Similarly, the inlet valve element 31 co-operates with a portion of the pump body 10 that is formed such that the pressure from the fluid contained in the pump chamber 20 also improves the leaktightness of said inlet valve 30. When the piston 50 reaches its dispensing position, the inlet valve element 31 co-operates with the outlet valve element 41 to move it mechanically into the open position of the outlet valve 40. The outlet valve being opened mechanically in this way at the end of the pump actuating stroke guarantees that a dose is dispensed in full each time the pump is actuated.

Figure 4:
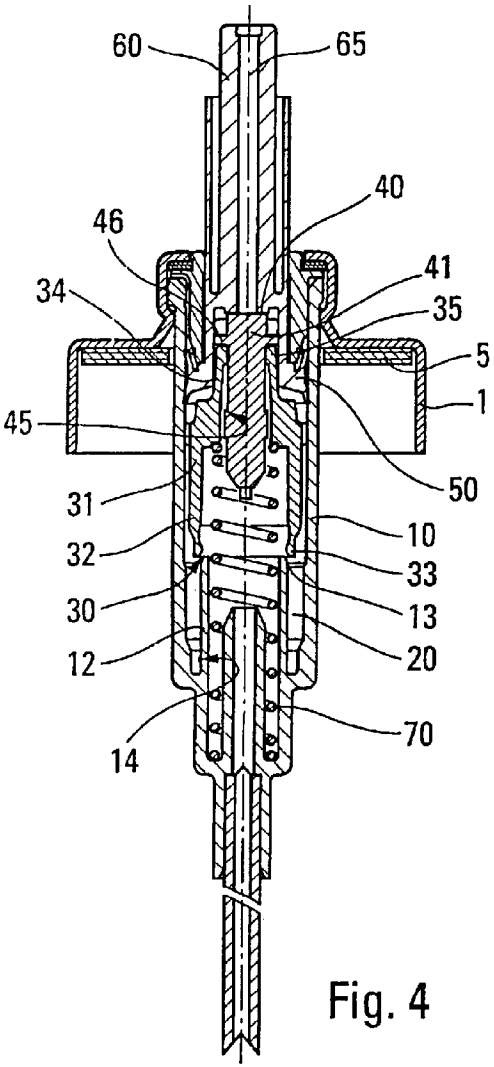
FIG. 4 is a diagrammatic section view of a second embodiment of the present invention, in the rest position.

Advantageously, the inlet valve element 31 comprises a bottom hollow axial sleeve 32 and a top hollow axial sleeve 34. The bottom axial sleeve 32 is mounted to slide in leaktight manner around a hollow axial tube 12 that is secured to or integral with the pump body 10. As shown in the figures, the axial tube 12 may be made integrally with the pump body 10, and may be disposed concentrically inside said pump body, at the bottom edge thereof. Sealing is provided at the bottom end 33 of said bottom sleeve 32, and this sealing is thus improved while the pump is being actuated by the pressure from the fluid contained in the pump chamber 20, the fluid spreading around said bottom sleeve 32 of the inlet valve element 31. When the pump is in the rest position, as shown in FIGS. 1 and 4, the bottom end 33 of said bottom sleeve 32 is spaced apart from the top end 13 of said axial tube 12, thereby defining the open position for the inlet valve 30, by opening up a passageway through which the fluid can flow into the pump chamber 20.

Figure 2:
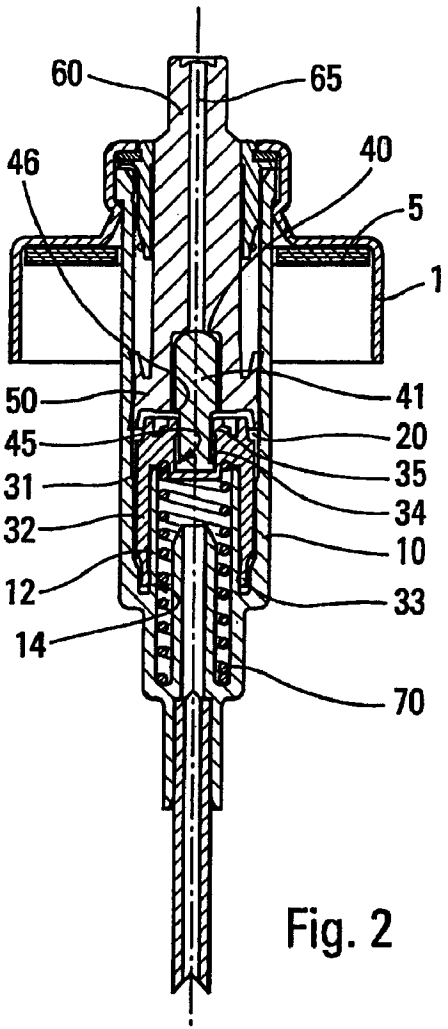
FIG. 2 is a view similar to the view in FIG. 1, in the priming position.

Advantageously, said axial tube 12 of the pump body 10 may be provided with one or more radial projections 14 which are preferably formed on its bottom portion, and which co-operate with the bottom end 33 of said bottom sleeve 32 of the inlet valve element 31 when the pump is actuated for the first time. This makes it possible to prime the pump reliably and simply by removing the air contained in the pump chamber 20 through the dip tube and into the reservoir (not shown). FIGS. 2 and 4 show the priming position, in which the bottom end 33 of the bottom sleeve 32 co-operates with said radial projections 14 on the axial tube 12. This makes it possible to open up a passageway through which the air contained in the pump chamber 20 can be expelled. Naturally, after the pump has been primed, the pump chamber 20 fills with fluid from the reservoir (not shown). From that moment on, since the fluid is not compressible, unlike air, the inlet valve element 31 no longer reaches the position in which its bottom end 33 can co-operate with said radial projections 14 on the axial tube 12. The outlet valve 40 of the pump is always opened mechanically by said inlet valve element 31 before said bottom edge 33 of said inlet valve element 31 reaches said radial projections 14. The presence of said radial projections 14 thus makes it possible to prime the pump, but presents no risk of any leakage, in particular at the inlet valve 30, when the pump is actuated subsequently. The invention thus provides priming that is simple, safe and reliable, and removing the air through the dip tube makes it possible to use the pump of the present invention with any type of closure means, including closure means that do not enable air to be expelled during priming.

The top hollow axial sleeve 34 of the inlet valve element 31 is provided with a top edge 35 that forms an inwardly-extending radial shoulder. Said top edge 35 is mounted to slide, preferably in leaktight manner, around a portion of said outlet valve element 41, defined between respective top and bottom outwardly-extending radial shoulders 45 and 46. Thus, the top edge 35 of the top sleeve 34 co-operates with said bottom shoulder 45 of the outlet valve element 41 to open said outlet valve 40 mechanically when the piston 50 reaches its dispensing position. Because of the differences in diameter between the piston 50 and the inlet valve element 31, said inlet valve element moves faster in the pump body 10 than the piston 50 during actuation, so that the top edge 35 of the inlet valve element 31 slides around the outlet valve element 41, to reach said shoulder 45 and to open the outlet valve 40 mechanically.

Figure 1:
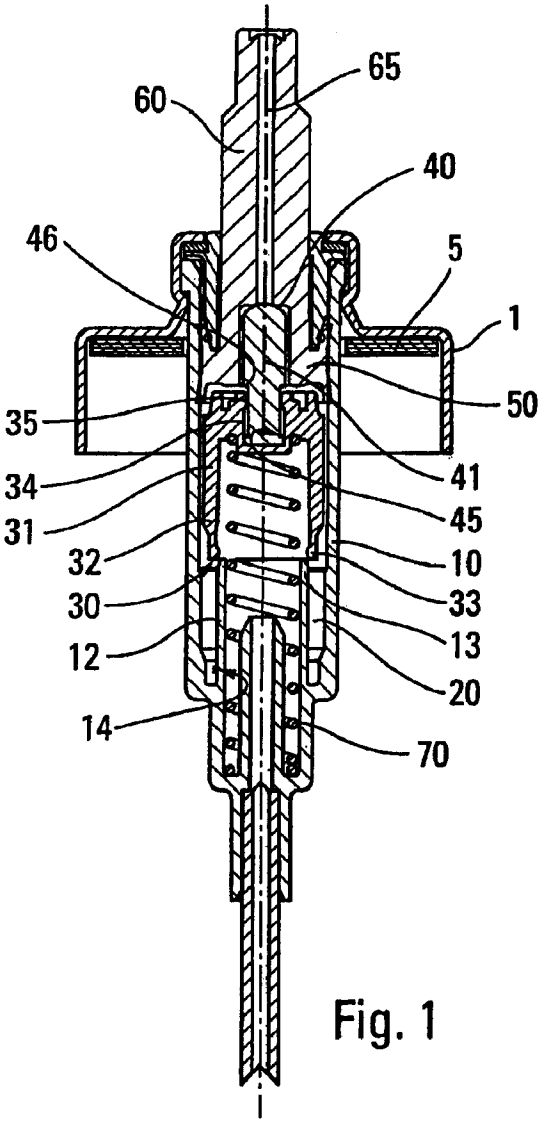
FIG. 1 is a diagrammatic section view of a pump in a first embodiment of the present invention, in the rest position.
Figure 5:
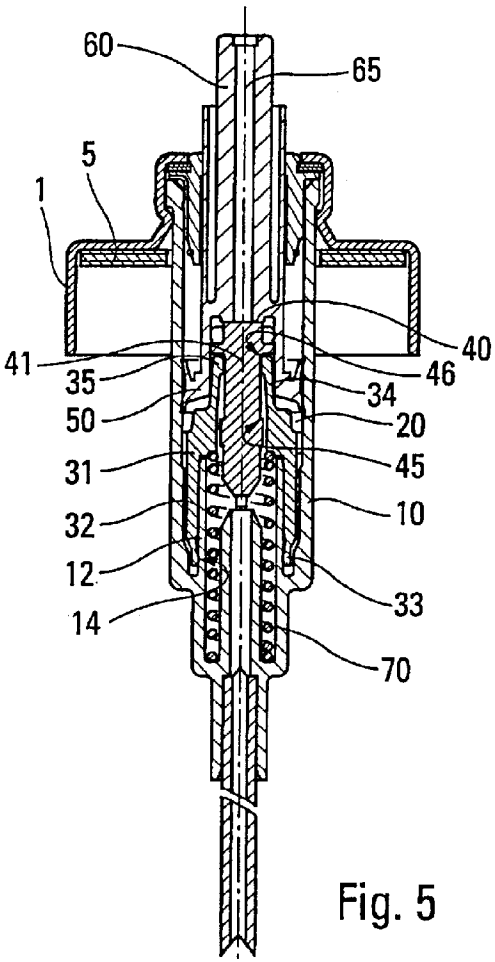
FIG. 5 is a view similar to the view in FIG. 4, in the priming position.

In the embodiment shown in FIGS. 1 to 3, after the pump has been actuated, the outlet valve is returned automatically to its closed position by the fluid entering the pump chamber 20 when the piston 50 returns from its dispensing position to its rest position. In a variant, the embodiment shown in FIGS. 4 to 6 makes provision for the top edge 35 of the top sleeve 34 of the inlet valve element 31 to co-operate with said top shoulder 46 of the outlet valve element 41 to close said outlet valve 40 again mechanically after the fluid contained in the pump chamber 20 has been expelled. Naturally, this characteristic of the outlet valve 40 being closed again mechanically could be adapted in the first embodiment described with reference to FIGS. 1 to 3.

A spring 70, forming a pump return spring is advantageously disposed between the pump body 10 and the inlet valve 31. The spring 70 urges the inlet valve 30 towards its open position and urges the piston 50 towards its rest position.

The present invention thus provides a pump that is safe and reliable, that avoids any risk of leakage while it is being actuated, that makes it possible for priming to take place reliably when the pump is actuated for the first time, and above all that is simple and inexpensive to manufacture and to assemble since it comprises only a very small number of component parts. To obtain this pump with all of these advantages, the present invention uses only six parts, namely the pump body 10, the inlet valve element 31, the outlet valve element 41, the return spring 70, the piston 50, and a ferrule 80 (which is the abutment element fitted into the top edge of the pump body 10 and which defines the rest position for the piston 50).

Naturally, the present invention is described with reference to two particular embodiments of it, and the person skilled in the art may make any modifications to them without going beyond the ambit of the present invention as defined by the accompanying claims.

What is claimed is:

1. A manually-actuated fluid dispenser pump including a pump body (10) containing a pump chamber (20), said pump chamber (20) being defined between an inlet valve (30) and an outlet valve (40), a piston (50) being mounted to slide in said pump body (10) between a rest position and a dispensing position for dispensing the fluid contained in the pump chamber, said piston (50) being connected to, and in particular integral with, an actuating rod (60) provided with an expulsion channel (65), said inlet valve (30) including an inlet valve element (31) mounted to move in the pump body (10) and co-operating with said pump body (10) or with an element secured to or integral with said pump body to define the open and the closed positions for said inlet valve (30), said outlet valve (40) including an outlet valve element (41) mounted to move in the pump body (10) and co-operating with said actuating rod (60) or with an element secured to or integral with said actuating rod to define the open and the closed positions for said outlet valve (40), wherein, during actuation, said outlet valve (40) is urged into its closed position by the pressure from the fluid contained in the pump body (20), said outlet valve element (41) being moved into the open position of the outlet valve (40) by said inlet valve element (31) when the piston (50) reaches its dispensing position; and wherein said inlet valve element (31) includes a bottom hollow axial sleeve (32) which, when said inlet valve is in the closed position (30), slides in leaktight manner around a hollow axial tube (12) secured to or integral with the pump body (10), a bottom end (33) of said bottom sleeve (32) being spaced apart from a ton end (13) of said axial tube (12) when said inlet valve (30) is in the open position to define a passageway through which fluid can flow into the pump chamber (20).

2. A pump according to claim 1, in which said axial tube (12) of the pump body (10) is provided with one or more radial projections (14) co-operating with the bottom end (33) of said bottom sleeve (32) of the inlet valve element (31) when the pump is actuated for the first time to open up a passageway for expelling the air contained in the pump chamber (20) so as to prime the pump.

3. A pump according to claim 1, in which said inlet valve element (31) includes a top hollow axial sleeve (34) whose top edge (35) forms an inwardly-extending radial shoulder and which is mounted to slide around said outlet valve element (41) between bottom and top outwardly-extending radial shoulders (45, 46) on said outlet valve element (41).

4. A pump according to claim 3, in which said top edge (35) of the top sleeve (34) co-operates with said bottom shoulder (45) of the outlet valve element (41) to open said outlet valve (40) when the piston (50) reaches its dispensing position.

5. A pump according to claim 3, in which said top edge (35) of the top sleeve (34) co-operates with said top shoulder (46) on the outlet valve element (41) to close said outlet valve (40) again once the fluid contained in the pump chamber (20) has been expelled.

6. A pump according to claim 1, in which a spring (70) is disposed between the pump body (10) and the inlet valve element (31), said spring (70) urging said inlet valve (30) into its open position and urging the piston (50) into its rest position.

7. A fluid dispenser device, comprising:

a fixing ring; and a pump body secured to the fixing ring and comprising a pump chamber, said pump chamber being defined between an inlet valve and an outlet valve, a piston being mounted to slide in said pump body between a rest position and a dispensing position for dispensing the fluid contained in the pump chamber said piston being connected to and in particular integral with, an actuating rod provided with an expulsion channel said inlet valve including an inlet valve element mounted to move in the pump body and co-operating with said pump body or with an element secured to or integral with said pump body to define the open and the closed positions for said inlet valve, said outlet valve including an outlet valve element mounted to move in the pump body and co-operating with said actuating rod or with an element secured to or integral with said actuating rod to define the open and the closed positions for said outlet valve, wherein, during actuation, said outlet valve is urged into its closed position by the pressure from the fluid contained in the pump body, said outlet valve element being moved into the open position of the outlet valve by said inlet valve element when the piston reaches its dispensing position; and, wherein said inlet valve element includes a bottom hollow axial sleeve which, when said inlet valve is in the closed position, slides in leaktight manner around a hollow axial tube secured to or integral with the pump body, a bottom end of said bottom sleeve being spaced apart from a top end of said axial tube when said inlet valve is in the open position to define a passageway through which fluid can flow into the pump chamber.

* * * * *

UNITED STATES PATENT AND TRADEMARK OFFICE

CERTIFICATE OF CORRECTION

PATENT NO. : 6,866,168 B2
DATED : March 15, 2005
INVENTOR(S) : Ludovic Petit

It is certified that error appears in the above-identified patent and that said Letters Patent is hereby corrected as shown below:

Column 5,
Lines 44-45, delete “pump body (20)” and insert therefor -- pump chamber (20) --.
Lines 54-55, delete “ton end (13)” and insert therefor -- top end (13) --.

Signed and Sealed this

Seventh Day of June, 2005

JON W. DUDAS
*Director of the United States Patent and Trademark Office*